US005445899A

United States Patent [19]

Budzilek et al.

[11] Patent Number: 5,445,899

[45] Date of Patent: Aug. 29, 1995

[54] COLOR THIN FILM ELECTROLUMINESCENT DISPLAY

[75] Inventors: Russell A. Budzilek, Bridgeport; Dominick L. Monarchie, Norwalk; Myroslaw Podoba, Wallingford, all of Conn.; Elliott Schlam, Wayside, N.J.; Richard R. Swatson, Trumbull, Conn.

[73] Assignee: Westinghouse Norden Systems Corp., Norwalk, Conn.

[21] Appl. No.: 62,869

[22] Filed: May 17, 1993

Related U.S. Application Data

[63] Continuation-in-part of Ser. No. 990,991, Dec. 16, 1992.

[51] Int. Cl.[6] ..... H05B 33/02

[52] U.S. Cl. ..... 428/690; 428/691; 428/917; 313/505; 313/506; 313/509

[58] Field of Search ..... 428/690, 691, 917; 313/505, 509, 506

[56] References Cited

U.S. PATENT DOCUMENTS

| | | | |
|---|---|---|---|
| 4,287,449 | 9/1981 | Takada et al. | 313/509 |
| 4,602,189 | 7/1986 | Panicker | 313/505 |
| 4,613,793 | 9/1986 | Panicker et al. | 313/169.3 |
| 4,758,765 | 7/1988 | Mitsumori | 313/506 |
| 4,963,788 | 10/1990 | King et al. | 313/503 |

FOREIGN PATENT DOCUMENTS 159531 10/1985 European Pat. Off. .

OTHER PUBLICATIONS

Gregory et al, J. Electro Chem. Soc., vol. 138, No. 7 Jul. 1991.

Dobrowolski, Applied Optics vol. 31 No. 28 Oct. 1992.

Haaraner, et al; 19.3: A 9—In Diaganol High Contrast Multicolor TFEL Display: SID 92 Digest pp. 348–351.

*Primary Examiner*—Charles R. Nold

*Attorney, Agent, or Firm*—Christopher O. Edwards

[57] ABSTRACT

A multi-color TFEL display includes a low ohm metal assist structure in electrical contact with the transparent electrodes to improve display brightness, and a light absorbing dark layer to increase display contrast.

20 Claims, 6 Drawing Sheets

FIG. 3
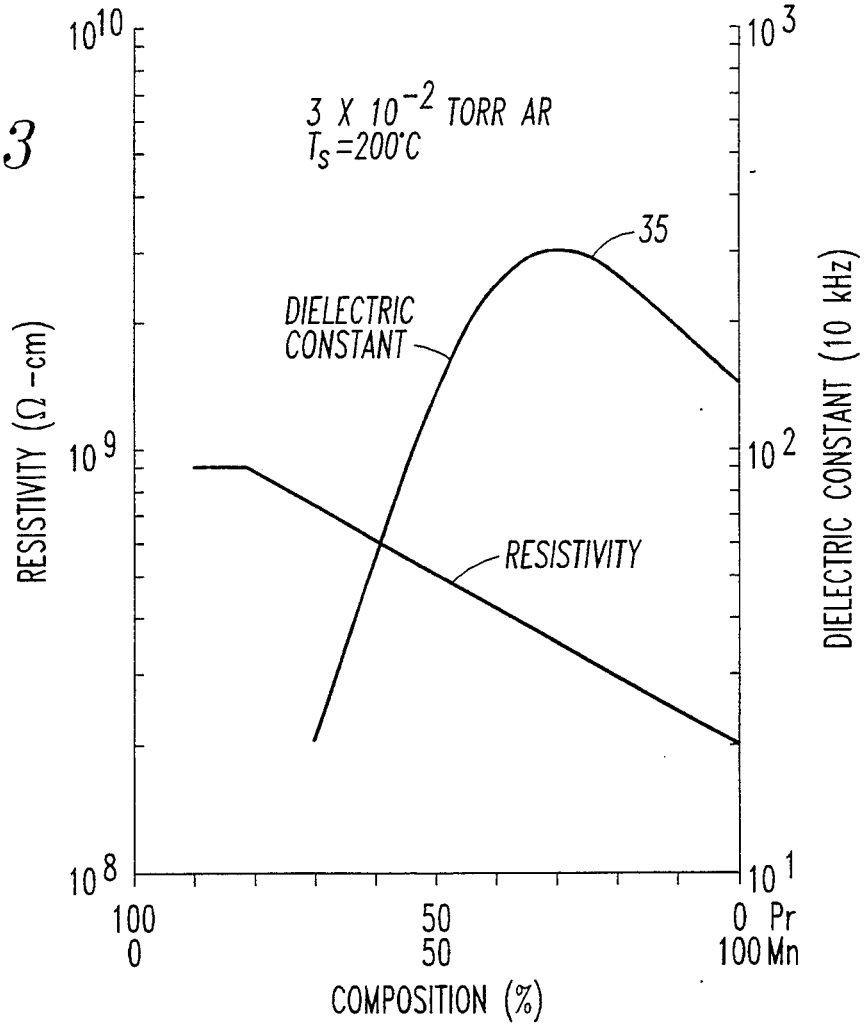
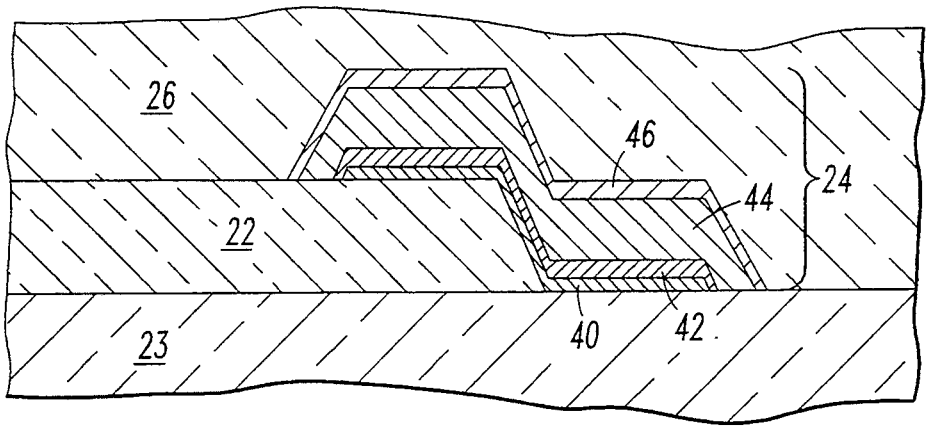
FIG. 4

COLOR THIN FILM ELECTROLUMINESCENT DISPLAY

GOVERNMENT RIGHTS IN THE INVENTION

This invention was made with government support under a contract awarded by the Advanced Research Project Agency (ARPA). The government has certain rights in this invention.

This application is a continuation-in-part of application Ser. No. 07/990,991, filed Dec. 16, 1993, now allowed, entitled "Sunlight Viewable Thin Film Electroluminescent Display", which is incorporated by reference herein.

CROSS REFERENCE TO RELATED APPLICATIONS

This application contains subject matter related to the following commonly assigned co-pending applications: Ser. No. 07/897,201, filed Jun. 11, 1992, now allowed entitled "Low Resistance, Thermally Stable Electrode Structure for Electroluminescent Displays"; Ser. No. 07/990,322, filed Dec. 14, 1992, now abandoned entitled "Sunlight Viewable Thin Film Electroluminescent Display Having Darkened Metal Electrodes"; and Ser. No. 07/989,672, filed Dec. 14, 1992, entitled "Sunlight Viewable Thin Film Electroluminescent Display Having a Graded Layer of Light Absorbing Dark Material".

1. Technical Field

This invention relates to electroluminescent displays and more particularly to color electroluminescent displays.

2. Background Art

Thin film electroluminescent (TFEL) display panels offer several advantages over older display technologies such as cathode ray tubes (CRTs) and liquid crystal displays (LCDs). Compared with CRTs, TFELs display panels require less power, provide a larger viewing angle, and are much thinner. Compared with LCDs, TFEL display panels have a larger viewing angle, do not require auxiliary lighting, and can have a larger display area.

FIG. 1 shows a prior art monochrome TFEL display panel. The monochrome TFEL display has a glass panel 11, a plurality of transparent electrodes 12, a first layer of a dielectric 13, a phosphor layer 14, a second dielectric layer 15, and a plurality of metal electrodes 16 perpendicular to the transparent electrodes 12. The transparent electrodes 12 are typically indium-tin oxide (ITO) and the metal electrodes 16 are typically A1. The dielectric layers 13,15 act as capacitors to protect the phosphor layer 14 from excessive currents. When an electrical potential, such as about 200 V, is applied by drive electronics 17 between the transparent electrodes 12 and the metal electrodes 16, electrons tunnel from one of the interfaces between the dielectric layers 13,15 and the phosphor layer 14 into the phosphor layer where they are rapidly accelerated. The phosphor layer 14 typically comprises ZnS doped with Mn in a monochrome TFEL display. Electrons entering the phosphor layer 14 excite the Mn causing the Mn to emit photons. The photons pass through the first dielectric layer 13, the transparent electrodes 12, and the glass panel 11 to form a visible image.

Color TFEL panels are also known in the art. As an example, U.S. Pat. No. 4,717,606 issued Jan. 6, 1988 and assigned to Rockwell International Corporation discloses ion implanting various dopants into a ZnS host to create a multi-color display. However, a problem with known red-green-blue (RGB) color TFEL displays is the lack of blue brightness. Although current color TFEL displays are satisfactory for some applications where there is low ambient lighting, more advanced applications require brighter, higher contrast displays, larger displays, and sunlight viewable color displays. In an effort to overcome these problems there is a great deal of ongoing industry research and development to improve TFEL phosphors and thus increase display brightness, especially blue phosphor. In the mean time other display improvements will continue to increase the brightness and contrast of multi-color TFEL displays.

DISCLOSURE OF THE INVENTION

An object of the present invention is to provide a color TFEL display having improved brightness and improved contrast.

Another object of the present invention is to provide a more easily manufactured color TFEL display.

According to the present invention, an enhanced brightness color TFEL display includes a phosphor layer of ZnS having preselected phosphor activators and co-activators implanted therein, and a layer of light absorbing dark material is included within the color TFEL having a low ohm metal assist structure in electrical contact over each transparent electrode.

The combination of the low ohm metal assist structure for each transparent electrode and implantation of the phosphor activators and co-activators in the ZnS host material provides an enhanced brightness, easily manufactured multi-color TFEL display. The addition of a light absorbing dark layer to the multi-color TFEL display improves the contrast of the display.

The present invention provides a multi-color TFEL display panel which is comfortably viewable in direct sunlight.

These and other objects, features and advantages of the present invention will become more apparent in light of the following detailed description of a preferred embodiment thereof, as illustrated in the accompanying drawings.

BRIEF DESCRIPTION OF THE DRAWINGS

FIG. 3 is a plot of dielectric characteristics versus target composition of praseodymium;

FIG. 4 illustrates a preferred embodiment of the low ohm metal assist structure;

BEST MODE FOR CARRYING OUT THE PRESENT INVENTION

This application is a continuation-in-part of application Ser. No, 07/990,991, filed Dec. 16, 1992, entitled "Sunlight Viewable Thin Film Electroluminescent Display".

Figure 1:
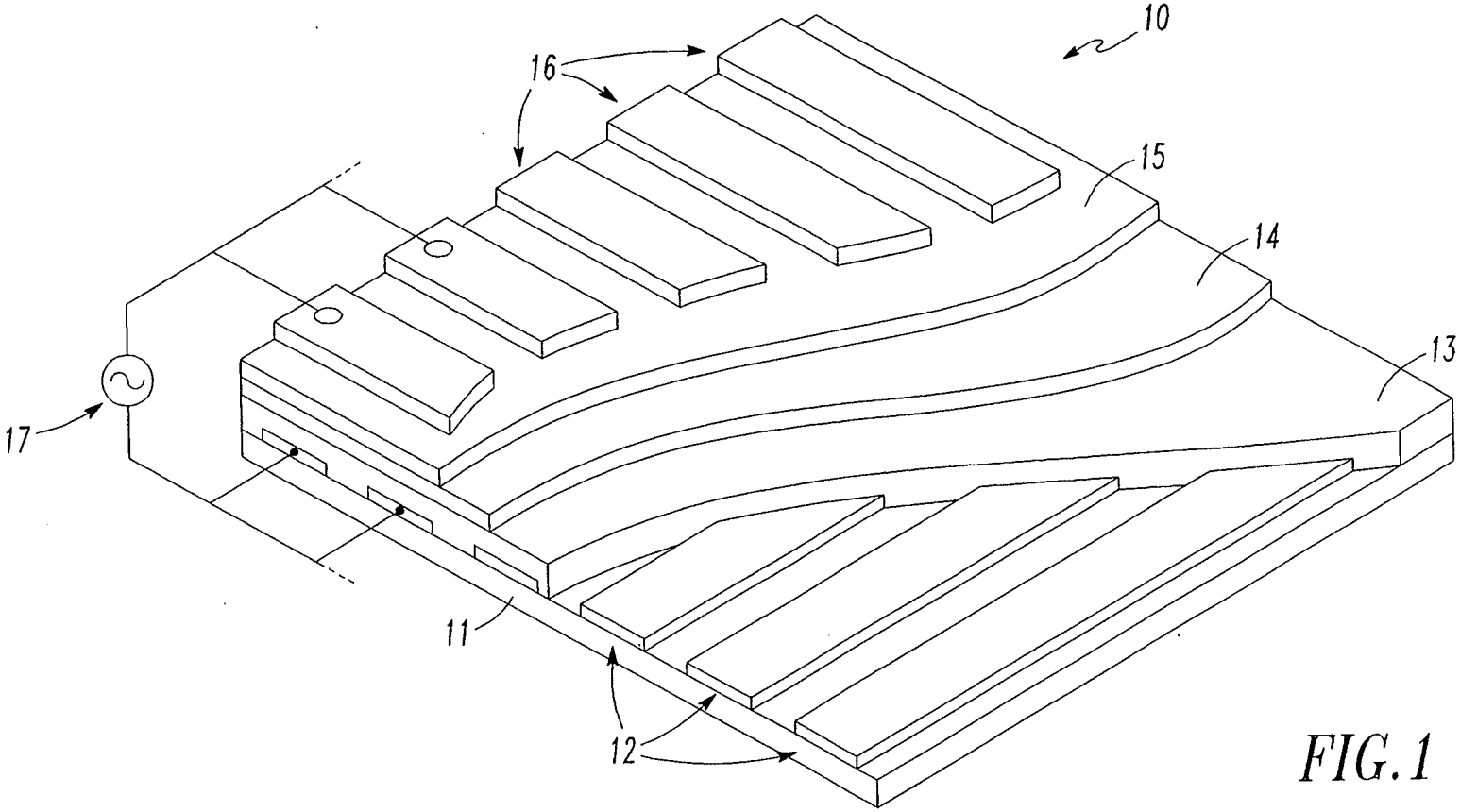
FIG. 1 illustrates a prior art monochrome TFEL display panel.
Figure 2:
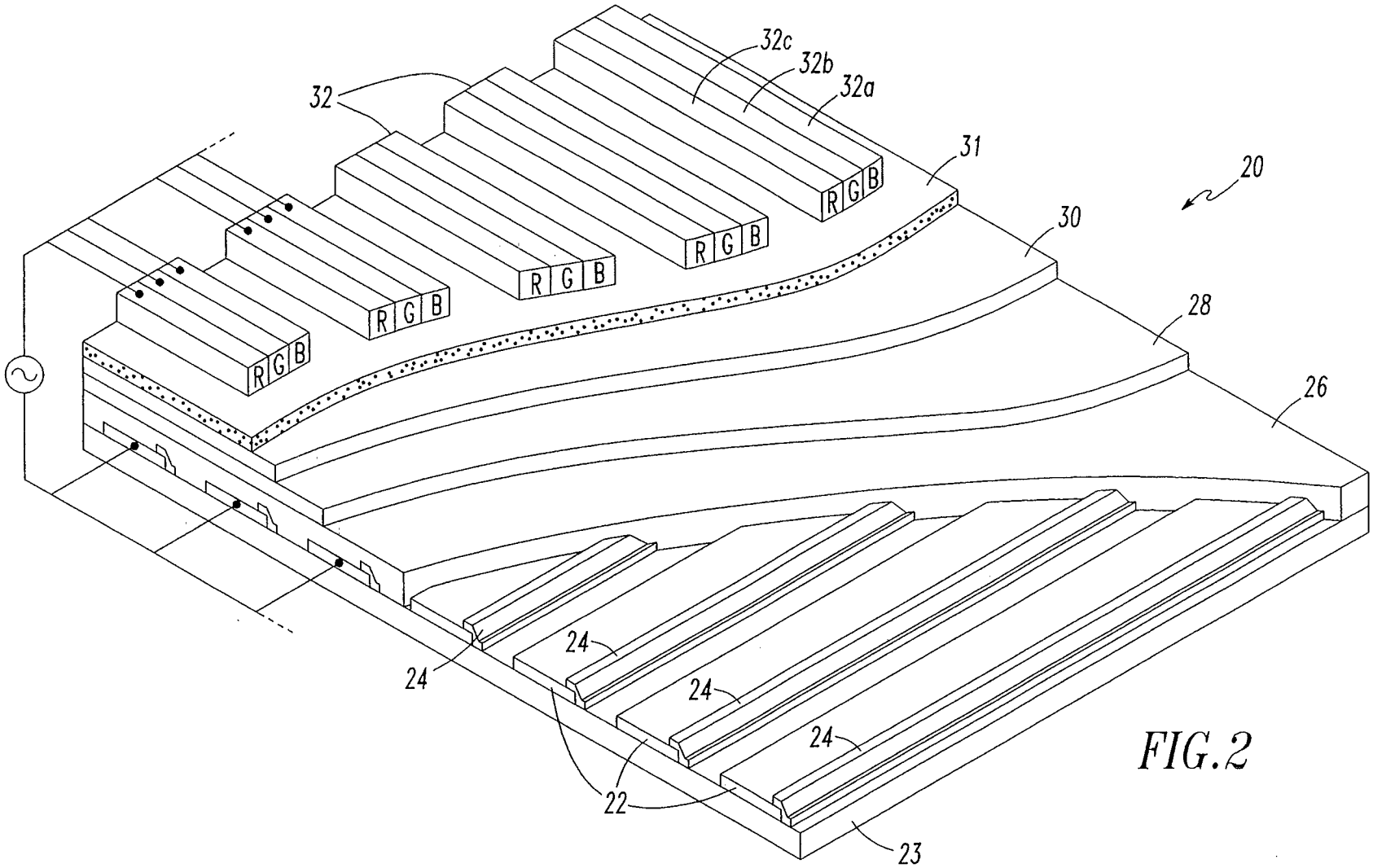
FIG. 2 illustrates a multi-color thin film electroluminescent display according to the present invention.

Referring to FIG. 2, a multi-color thin film electroluminescent (TFEL) display 20 includes a plurality of transparent electrodes 22 deposited on a glass panel 23. Each of the transparent electrodes 22 includes a low resistance metal assist structure 24 in electrical contact with a portion of the transparent electrode 22 to decrease electrode resistance. Reducing the resistance of each transparent electrode allows the drive electronics to increase the refresh rate, and hence realize a brighter display since brightness is directly proportional to the refresh rate of the display. The multi-color TFEL also includes a first dielectric layer 26, a phosphor layer 28, a second dielectric layer 30, a layer of light absorbing dark material 31, and segmented metal electrodes 32 which run orthogonal to the transparent electrodes 22. Each segmented electrode includes sub-electrodes **32*a*,32*b*,32*c*** (e.g., three for a RGB display) each independently addressable for selecting the desired color at a particular pixel site.

Each metal assist structure 24 extends the entire length of its corresponding transparent electrode 22 and can include one or more layers of an electrically conductive metal compatible with the transparent electrode 22 and other structures within the display 20. To decrease the amount of light transmissive area covered by the metal assist structure 24, the structure should cover only a small portion of the transparent electrode 22. For example, the metal assist structure 24 can cover about 10% or less of the transparent electrode 22. Therefore, for a typical transparent electrode 22 that is about 250 μm (10 mils) wide, the metal assist structure 24 should overlap the transparent electrode by about 25 μm (1 mill) or less. Overlaps as small as about 6 μm (0.25 mils) to about 13 μm (0.5 mils) are desirable. Although the metal assist structure 24 should overlap the transparent electrode 22 as little as possible, the metal assist structure should be as wide as practical to decrease electrical resistance. For example, a metal assist structure 24 that is about 50 μm (2 mils) to about 75 μm (3 mils) wide may be desirable. These two design parameters can be satisfied by allowing the metal assist structure 24 to overlap the glass panel 23 as well as the transparent electrode 22. With current fabrication methods, the thickness of the metal assist structure 24 should be equal to or less than the thickness of the first dielectric layer 26 to ensure that the first dielectric layer 26 adequately covers the transparent electrode 22 and metal assist structure 24. For example, the metal assist structure 24 can be less than about 250 nm thick. Preferably, the metal assist structure will be less than about 200 nm thick, such as between about 150 nm and about 200 nm thick. However, as fabrication methods improve, it may become practical to make metal assist structures 24 thicker than the first dielectric layer 26.

The layer of light absorbing dark material 31 reduces the amount of ambient light reflected by the aluminum rear electrodes 32, and hence improves the display's contrast. The dark layer 31 should be in direct contact with the aluminum rear electrodes 32 and have a resistivity large enough to reduce electrical crosstalk between the rear electrodes 32, which is a result of leakage currents between the rear electrodes. Preferably, the dark material should have a resistivity at least $10^8$ ohms.cm. The layer of dark material 31 should also have a dielectric constant which is at least equal to or greater than the dielectric constant of the second dielectric 30, and preferably have a dielectric constant greater than seven. In order to provide a diffuse reflectance of less than 0.5%, the dark material should also have a light absorption coefficient of about $10^5$/cm.

Candidate materials for the layer of dark material 31 include Ge, CdTe, CdSe, $Sb_2S_3$, GeN and $PrMnO_3$. The use of Ge has been marginally successfully and a more appropriate material may be GeN due to its higher breakdown threshold. $PrMnO_3$ in the proper composition has resistivity of greater than $10^8$ ohms.cm, a dielectric constant between 200 and 300, and a light absorption coefficient of greater than $10^5$ /cm at 500 nm. This combination of properties makes $PrMnO_3$ the preferred black layer material. Pr-Mn oxide films can be deposited using RF sputtering techniques with substrate temperatures ranging between 200–350 deg C. in an Ar or $Ar+O_2$ atmosphere. FIG. 3 is an illustration of how the resistivity and dielectric constant of the $PrMnO_3$ can be tailored for the particular application by varying the composition of the Pr—Mn oxide film. Note that the extremely high dielectric constant achievable with $PrMnO_3$ as shown along a line 35, implies that $PrMnO_3$ can be utilized without having to significantly increase the display's threshold voltage.

Referring to FIG. 4, a preferred embodiment of the metal assist structure 24 is a sandwich of an adhesion layer 40, a first refractory metal layer 42, a primary conductor layer 44, and a second refractory metal layer 46. The adhesion layer 40 promotes the bonding of the metal assist structure 24 to the glass panel 23 and the transparent electrode 22. It can include any electrically conductive metal or alloy that can bond to the glass panel 23, transparent electrode 22, and first refractory metal layer 42 without forming stresses that may cause the adhesion layer 40 or any of the other layers to peel away from these structures. Suitable metals include Cr, V, and Ti. Cr is preferred because it evaporates easily and provides good adhesion. Preferably, the adhesion layer 40 will be only as thick as needed to form a stable bond between the structures it contacts. For example, the adhesion layer 40 can be about 10 nm to about 20 nm thick. If the first refractory metal layer 42 can form stable, low stress bonds with the glass panel 23 and transparent electrode 22, the adhesion layer 40 may not be needed. In than case, the metal assist structure 24 can have only three layers: the two refractory metal layers 42,46 and the primary conductor layer 44.

The refractory metal layers 42,46 protect the primary conductor layer 44 from oxidation and prevent the primary conductor layer from diffusing into the first dielectric layer 26 and phosphor layer 28 when the display is annealed to activate the phosphor layer as described below. Therefore, the refractory metal layers 42,46 should include a metal or alloy that is stable at the annealing temperature, can prevent oxygen from penetrating the primary conductor layer 44, and can prevent the primary conductor layer 44 from diffusing into the first dielectric layer 26 or the phosphor layer 28. Suitable metals include W, Mo, Ta, Rh, and Os. Both refractory metal layers 42,46 can be up to about 50 nm thick. Because the resistivity of the refractory layer can be higher than the resistivity of the primary conductor 44, the refractory layers 42,46 should be as thin as possible to allow for the thickest possible primary conductor layer 44. Preferably, the refractory metal layers 42,46 will be about 20 nm to about 40 nm thick.

The primary conductor layer 44 conducts most of the current through the metal assist structure 24. It can be any highly conductive metal or alloy such as Al, Cu, Ag, or Au. Al is preferred because of its high conductivity, low cost, and compatibility with later processing. The primary conductor layer 44 should be as thick as possible to maximize the conductivity of the metal assist structure 24. Its thickness is limited by the total thickness of the metal assist structure 24 and the thicknesses of the other layers. For example, the primary conductor layer 44 can be up to about 200 nm thick. Preferably, the primary conductor layer 44 will be about 50 nm to about 180 nm thick.

The TFEL display of the present invention can be made by any method that forms the desired structures. The transparent electrodes 22, dielectric layers 26,30, phosphor layer 28 and metal electrodes 32 can be made with conventional methods known to those skilled in the art. The metal assist structure 24 can be made with an etch-back method, a lift-off method, or any other suitable method.

The first step in making a TFEL display like the one shown in FIG. 2 is to deposit a layer of a transparent conductor on a suitable glass panel 23. The glass panel can be any high temperature glass that can withstand the phosphor anneal step described below. For example, the glass panel can be a borosilicate glass such as Corning 7059 (Corning Glassworks, Corning, N.Y.). The transparent conductor can be any suitable material that is electrically conductive and has a sufficient optical transmittance for a desired application. For example, the transparent conductor can be ITO, a transition metal semiconductor that comprises about 10 mole percent In, is electrically conductive, and has an optical transmittance of about 85% at a thickness of about 300 nm. The transparent conductor can be any suitable thickness that completely covers the glass and provides the desired conductivity. Glass panels on which a suitable ITO layer has already been deposited can be purchased from Donnelly Corporation (Holland, Mich.). The remainder of the procedure for making a TFEL display of the present invention will be described in the context of using ITO for the transparent electrodes. One skilled in the art will recognize that the procedure for a different transparent conductor would be similar.

ITO electrodes 22 can be formed in the ITO layer by a conventional etch-back method or any other suitable method. For example, parts of the ITO layer that will become the ITO electrodes 22 can be cleaned and covered with an etchant-resistant mask. The etchant-resistant mask can be made by applying a suitable photoresist chemical to the ITO layer, exposing the photoresist chemical to an appropriate wavelength of light, and developing the photoresist chemical. A photoresist chemical that contains 2-ethoxyethyl acetate, n-butyl acetate, xylene, and xylol as primary ingredients is compatible with the present invention. One such photoresist chemical is AZ 4210 Photoresist (Hoechst Celanese Corp., Somerville, N.J.). AZ Developer (Hoechst Celanese Corp., Somerville, N.J.) is a proprietary developer compatible with AZ 4210 Photoresist. Other commercially available photoresist chemicals and developers also may be compatible with the present invention. Unmasked parts of the ITO are removed with a suitable enchant to form channels in the ITO layer that define sides of the ITO electrodes 22. The enchant should be capable of removing unmasked ITO without damaging the masked ITO or glass under the unmasked ITO. A suitable ITO enchant can be made by mixing about 1000 ml $H_2O$, about 2000 ml HCl, and about 370 g anhydrous $FeCl_3$. This enchant is particularly effective when used at about 55° C. The time needed to remove the unmasked ITO depends on the thickness of the ITO layer. For example, a 300 nm thick layer of ITO can be removed in about 2 min. The sides of the ITO electrodes 22 should be chamfered, as shown in the figures, to ensure that the first dielectric layer 26 can adequately cover the ITO electrodes. The size and spacing of the ITO electrodes 22 depend on the dimensions of the TFEL display. For example, a typical 12.7 cm (5 in) high by 17.8 cm (7 in) wide display can have ITO electrodes 22 that are about 30 nm thick, about 250 μm (10 mils) wide, and spaced about 125 μm (5 mils) apart. After etching, the etchant-resistant mask is removed with a suitable stripper, such as one that contains tetramethylammonium hydroxide. AZ 400T Photoresist Stripper (Hoechst Celanese Corp.) is a commercially available product compatible with the AZ 4210 Photoresist. Other commercially available strippers also may be compatible with the present invention.

After forming ITO electrodes 22, layers of the metals that will form the metal assist structure are deposited over the ITO electrodes with any conventional technique capable of making layers of uniform composition and resistance. Suitable methods include sputtering and thermal evaporation. Preferably, all the metal layers will be deposited in a single run to promote adhesion by preventing oxidation or surface contamination of the metal interfaces. An electron beamevaporation machine, such as a Model VES-2550 (Airco Temescal, Berkeley, Calif.) or any comparable machine, that allows for three or more metal sources can be used. The metal layers should be deposited to the desired thickness over the entire surface of the panel in the order in which they are adjacent to the ITO.

The metal assist structures 24 can be formed in the metal layers with any suitable method, including etch-back. Parts of the metal layers that will become the metal assist structures 24 can be covered with an etchant-resistant mask made from a commercially available photoresist chemical by conventional techniques. The same procedures and chemicals used to mask the ITO can be used for the metal assist structures 24. Unmasked parts of the metal layers are removed with a series of etchants in the opposite order from which they were deposited. The etchants should be capable of removing a single, unmasked metal layer without damaging any other layer on the panel. A suitable W etchant can be made by mixing about 400 ml $H_2O$, about 5 ml of a 30 wt % $H_2O_2$ solution, about 3 g $KH_2PO_4$, and about 2 g KOH. This etchant, which is particularly effective at about 40° C., can remove about 40 nm of a W refractory metal layer in about 30 sec. A suitable Al etchant can be made by mixing about 25 ml $H_2O$, about 160 ml $H_3PO_4$, about 10 ml $HNO_3$, and about 6 ml $CH_3COOH$. This etchant, which is effective at room temperature, can remove about 120 nm of an Al primary conductor layer in about 3 min. A commercially available Cr etchant that contains $HClO_4$ and $Ce(NH_4)_2(NO_3)_6$ can be used for the Cr layer. CR-7 Photomask (Cyantek Corp., Fremont, Calif.) is one Cr etchant compatible with the present invention. This etchant is particularly effective at about 40° C. Other commercially-available Cr etchants also may be compatible with the present invention. As with the ITO electrodes 22, the sides of the metal assist structures 24 should be chamfered to ensure adequate step coverage.

The dielectric layers 26,30 can be deposited over the ITO lines 22 and metal assist structures 24 by any suitable conventional method, including sputtering or evaporation. The two dielectric layers 26,30 can be any suitable thickness, such as about 80 nm to about 250 nm thick, and can comprise any dielectric capable of acting as a capacitor to protect the phosphor layer 28 from excessive currents. Preferably, the dielectric layers 26,30 will be about 200 nm thick and will comprise $SiO_xN_x$.

The phosphor layer 28 can be any conventional TFEL phosphor, such as ZnS doped with a preselected phosphor activator a preselected phosphor co-activators to provide a multi-colored (e.g., RGB) TFEL display. Preferably, the phosphor layer 28 will be about 1000 nm thick. One approach is to deposit the ZnS host material of the phosphor layer 28 using metal organic chemical vapor deposition (MOCVD). The MOCVD deposition technique rapidly forms single crystal or very large grain polycrystalline films with precise control of stoichiometry at relatively low temperatures. The principal advantage of the MOCVD in depositing TFEL phosphors are its high growth rate (typically 10 angromstroms/second) and the excellent control it provides over uniformity, crystallinity and doping profiles.

Ion implantation may be used for introducing the phosphor activators and co-activators in the ZnS host material since it allows in a well known manner the implantation of activators and co-activators for different colors using shadow or photoresist masking, thus eliminating several prior art lithographic, etching, and deposition steps. U.S. Pat. Nos. 4,717,606, 4,987,339, 5,047,686 and 5,104,683 each disclose ion implantation for TFEL activators and co-activators.

Ion implantation of the activators and co-activators into the phosphor layer is done is such a way so the bulk of the ZnS host is neither damaged nor contaminated by the implanted ions. In addition, localization of the implanted activators and co-activators within the ZnS host material increases the density of energetic electrons in the undoped portions of the ZnS host material. The result is an increased population of energetic electrons which increase the excitation rate of optically active transitions in the activator and the luminous output of the phosphor, and hence increase display brightness.

Ion implantation enables incorporation of a broad range of preselected activator species in the proper ZnS lattice sites for efficient electroluminescence. Aluminum ions with co-activators such as chromium can be used to achieve a blue phosphor. Samarium may be used for red with a co-activator such as phosphorus to increase the brightness of the red phosphor. Terbium with a halogen co-activator can be used to provide the green phosphor. Other choices include SmF and SmCl for red; TbF, Er and TbCl for green; and Tm and TmCl for blue.

Ion implantation of preselected phosphor activators and co-activators can be performed using a Varian DF-4 ion implanter. Typical ion implantation parameters include:

| COLOR | ION | ENERGY (KeV) | DOSE ($cm^2$) |
|---|---|---|---|
| yellow | $Mn^+$ | 190 | $1\times10^{14}$–$2\times10^{16}$ |
| green | $Tb^+$ | 190 | $1\times10^{15}$–$5\times10^{15}$ |
| blue | $Tm^+$ | 190 | $1\times10^{15}$– $5\times10^{15}$ |
| red | $Sm^+$ | 190 | $1\times10^{15}$– $5\times10^{15}$ |

After the phosphor layer 28 and the second dielectric layer 30 are deposited the display is heated in an oxygen free environment (e.g., nitrogen) to about 500° C. for about 1 hour to anneal the phosphor.

After annealing the phosphor layer 28, metal electrodes 32 are formed on the second dielectric layer 30 by any suitable method, including etch-back or lift-off. The metal electrodes 32 can be made from any highly conductive metal, such as Al. As with the ITO electrodes 22, the size and spacing of the metal electrodes **32*a*,32*b*,32*c* depend on the dimensions of the display. For example, a typical 12.7 cm (5 in) high by 17.8 cm (7 in) wide TFEL display can have metal electrodes 32 that are about 100 nm thick, about 250 μm (10 mils) wide, and spaced about 125 μm (5 mils) apart. The metal electrodes 32*a*,32*b*,32*c* should be perpendicular to the ITO electrodes 22** to form a grid.

Figure 5:
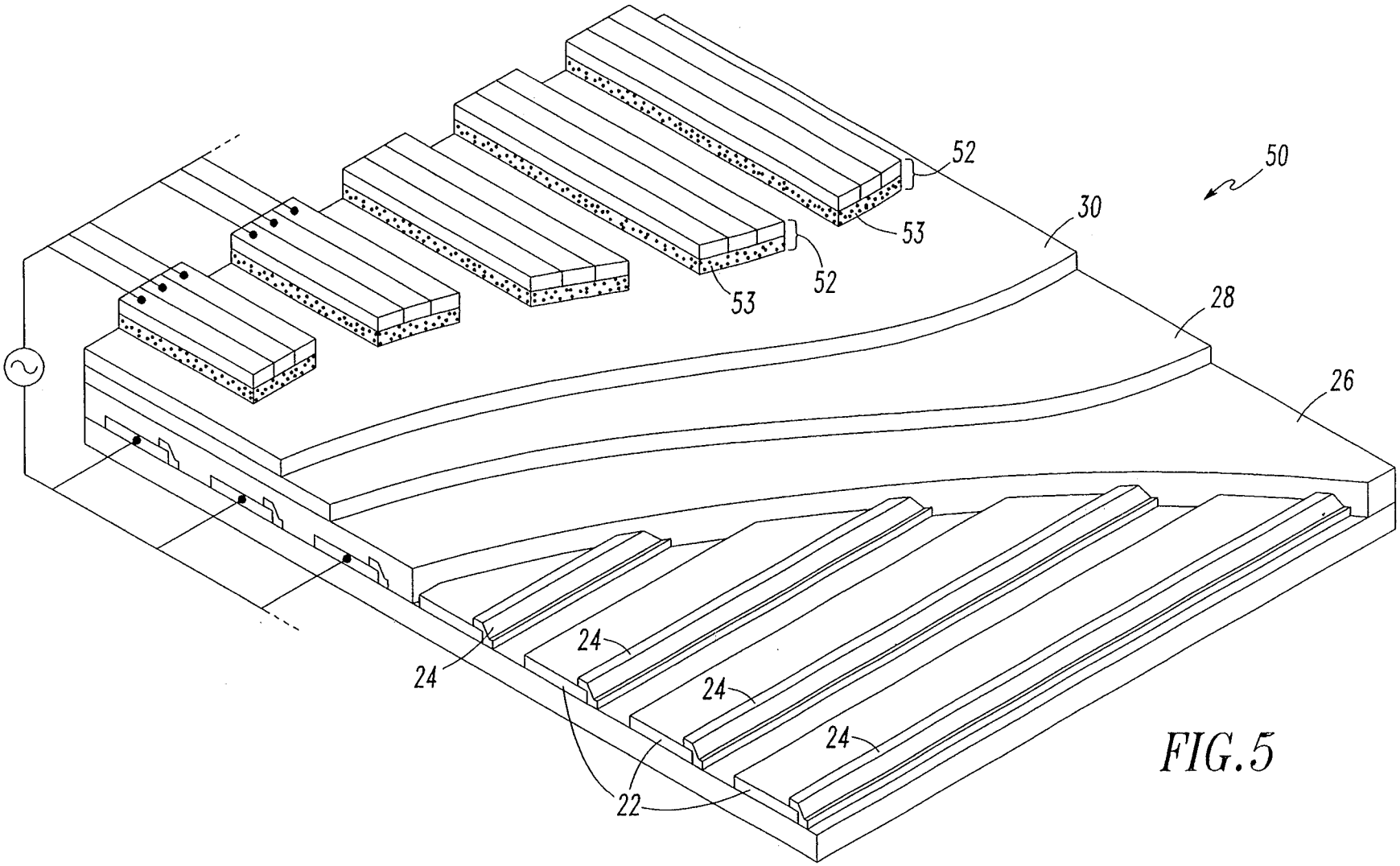
FIG. 5 illustrates an alternative embodiment of the present invention having a plurality of darkened rear metal electrodes.

Referring to FIG. 5, an alternative structure 50 for improving the contrast of a TFEL display panel includes a plurality of darkened rear electrodes 52. Rather than utilizing a distinct layer of light absorbing dark material as shown in FIG. 2, the embodiment of FIG. 5 employs a plurality of darkened rear electrodes 52. Preferably the rear electrodes 52 are Al, and are darkened by oxidization to achieve the required light absorption characteristics.

The darkened Al electrodes 52 can be fabricated by RF sputtering in an argon gas atmosphere. Mixing oxygen in the early stages of sputtering the Al layer to create the rear electrodes oxidizes (i.e., darken) a portion 53 of the Al in contact with the second dielectric layer 30. The remainder of the Al that is not darkened is deposited in the conventional manner without the introduction of any oxygen. The thickness of the oxidized layer can be varied as a function of the desired light absorption characteristics. In general however, the oxidized portion 53 of the rear electrodes is a relatively small percentage of the total rear electrode thickness and therefore has little effect on the overall resistance of each rear electrode. As an example, when the oxidized layer 53 represents 10% of the total rear electrode thickness, the overall resistance of the rear electrode will only increase about 11% (e.g., from about 126 ohms to about 140 ohms), assuming the following parameters:

| | | |
|---|---|---|
| Rear electrode length | = | 4.7 inches |
| Rear electrode width | = | 0.010 inches |
| Rear electrode thickness | = | 1000 angstroms |
| Oxidization thickness | = | 100 angstroms |
| Al resistivity | = | 0.269 ohms/sq(1000 A) |

To prevent the striped appearance that my exist from ambient light reflections off the glass panel 23 in between the rear electrodes 52, a black epoxy coating (not shown) can be applied to the panel 50. The reflectivity and color of the epoxy coating must be matched closely to the dark anodized surface of the darkened electrodes to ensure a uniformly dark display.

Figure 6:
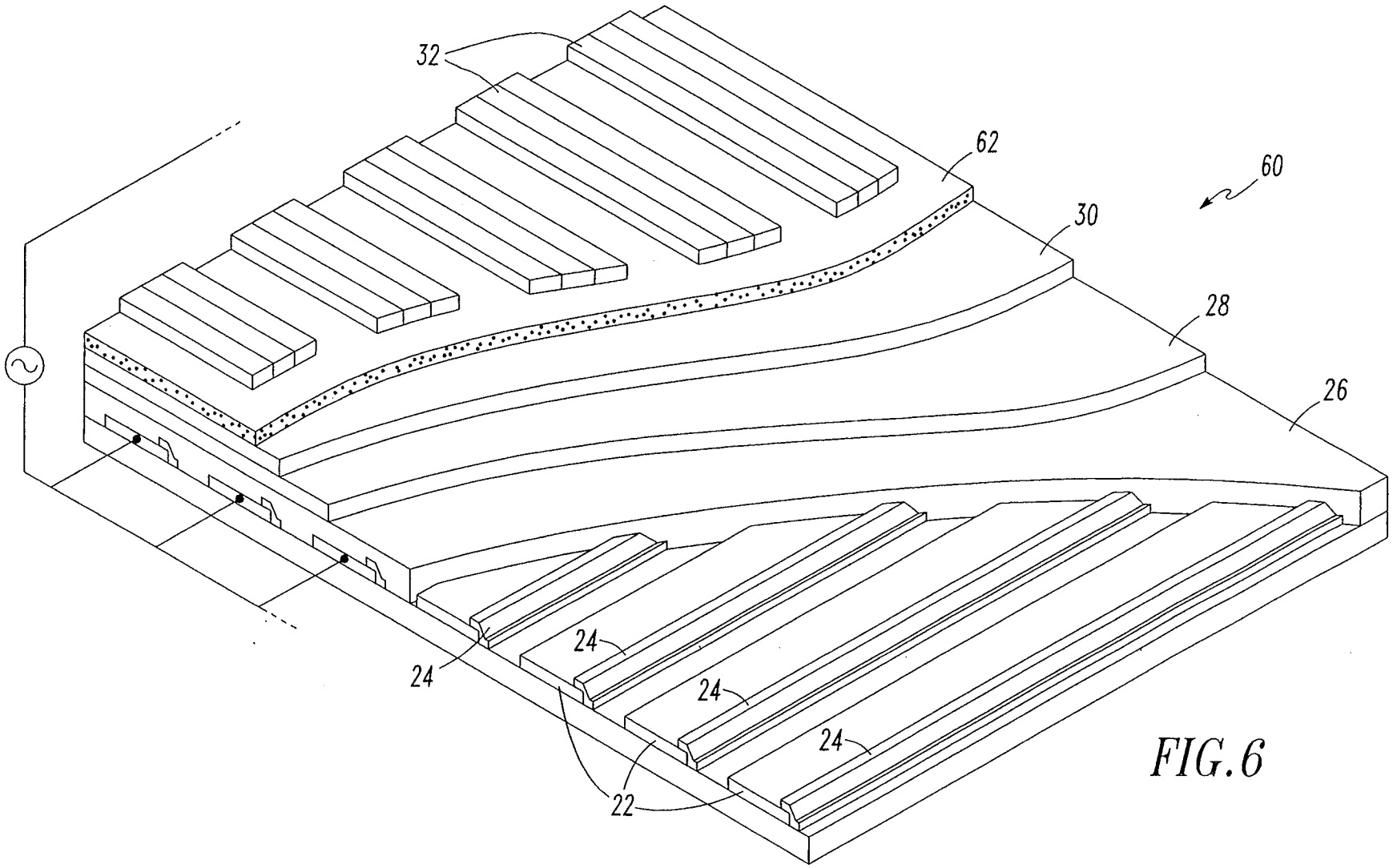
FIG. 6 illustrates yet another alternative embodiment of the present invention having a graded layer of light absorbing dark material.

Another alternative embodiment 60 of a TFEL display panel having a light absorbing dark layer 62 is illustrated in FIG. 6. This embodiment is similar to the embodiment shown in FIG. 2 with the important exception that the light absorbing layer 62 in this embodiment is a graded light absorbing layer and the material is a only a variation of the material used for the second dielectric layer 30 and not a unique material. The graded dark layer is a nonstoichiometric silicon nitride ($SiN_x$) which provides a high quality light absorbing layer, and can be produced rather easily by controlling the nitrogen/argon gas flow ratio during the standard dielectric deposition process.

Figure 7:
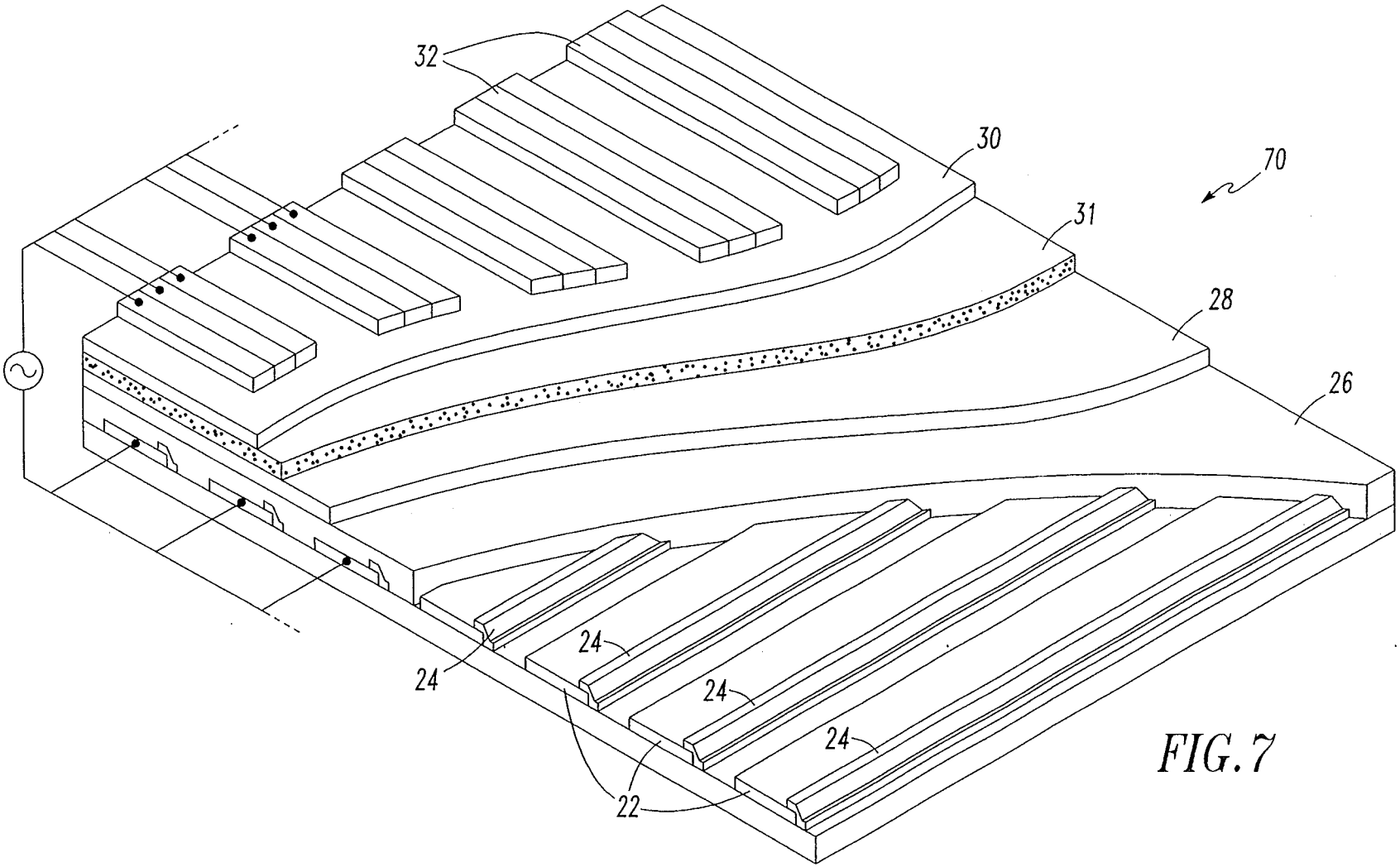
FIG. 7 illustrates still another alternative embodiment of the present invention wherein the light absorbing dark layer is located between the phosphor layer and the second dielectric layer.

FIG. 7 shows still another alternative embodiment 70 of the present invention. The embodiment 70 of FIG. 7 is similar to the embodiment of FIG. 2; the two embodiments differ primarily in that the position of the dark layer 31 and the second dielectric layer 30 are reversed. The remaining layers in the embodiment illustrated in FIG. 7 incorporate the same or substantially the same materials as the embodiment in FIG. 2.

In addition to the embodiments shown in FIGS. 2,5,6 and 7, the multi-color TFEL display of the present invention can have any other configuration that would benefit from the combination of low resistance transparent electrodes, and light absorbing dark material.

The present invention provides several benefits over the prior art. For example, the combination of low resistance electrodes and a layer of light absorbing dark material make multi-color TFEL displays of all sizes brighter. This makes large multi-color TFEL displays, such as a display about 91 cm (36 in) by 91 cm feasible since low resistance electrodes can provide enough current to all parts of the panel to provide even brightness across the entire panel, and the dark layer material reduces the reflection of ambient light to improve the panel's contrast. A display with low resistance electrodes and a dark layer can be critical in achieving sufficient contrast to provide a directly sunlight viewable multi-color TFEL display.

It should be understood the present invention is not limited to multi-color TFEL displays which use ion implantation to implant the activator and co-activators; thermal diffusion or any of the other well known processes may be used.

Although the invention has been shown and described with respect to a preferred embodiment thereof, it should be understood by those skilled in the art that various other changes, omissions, and additions may be made to the embodiments disclosed herein, without departing from the spirit and scope of the present invention.

We claim:

1. A sunlight viewable multi-color electroluminescent display panel, comprising:

a glass substrate;

a plurality of parallel transparent electrodes deposited on said glass substrate, each of said transparent electrodes having a metal assist structure formed on and in electrical contact over a portion of said transparent electrodes;

a first dielectric layer deposited on said plurality of transparent electrodes;

a layer of phosphor material deposited on said first dielectric layer having a preselected activator and a preselected co-activator implanted therein to provide color luminescent material;

a second dielectric layer deposited on said layer of phosphor material;

a layer of light absorbing dark material, deposited on said second dielectric layer for reducing reflected light; and a plurality of metal electrodes each deposited in parallel over said layer of light absorbing dark material.

2. The sunlight viewable multi-color electroluminescent display panel of claim 1, wherein each of said metal assist structures comprises a first refractory metal layer, a primary conductor layer formed on the first refractory layer, and a second refractory metal layer formed on the primary conductor layer such that the first and second refractory metal layers are capable of protecting the primary conductor payer from oxidation when the electroluminescent display is annealed to activate said phosphor layer.

3. The sunlight viewable electroluminescent display panel of claim 2 wherein said metal assist structure covers about 10% or less of said transparent electrode.

4. The sunlight viewable electroluminescent display panel of claim 2 wherein said layer of light absorbing dark material is $PrMnO_3$.

5. The sunlight viewable electroluminescent display panel of claim 1 wherein said layer of light absorbing dark material has a resistivity of least $10^8$ ohms.cm.

6. The sunlight viewable electroluminescent display panel of claim 1 wherein said layer of light absorbing dark material is GeN.

7. The sunlight viewable electroluminescent display panel of claim 2 wherein the edges of said metal assist structure are chamfered.

8. The sunlight viewable electroluminescent display panel of claim 2, wherein said metal assist structure further comprises an adhesion layer formed between said first refractory metal layer and the transparent electrode, wherein said adhesion layer is capable of adhering to the transparent electrode and said first refractory metal layer.

9. A sunlight viewable multi-color electroluminescent display panel, comprising:

a glass substrate;

a plurality of parallel transparent electrodes deposited on said glass substrate, each of said transparent electrodes having a metal assist structure formed on and in electrical contact over a portion of said transparent electrodes;

a first dielectric layer deposited on said plurality of transparent electrodes;

a layer of phosphor material deposited on said first dielectric layer having a preselected activator and a preselected co-activator implanted therein to provide color luminescent material;

a layer of light absorbing dark material, deposited on said layer of phosphor material for reducing reflected light;

a second dielectric layer deposited on said layer of light absorbing dark material; and a plurality of metal electrodes each deposited in parallel over said layer of light absorbing dark material.

10. The sunlight viewable electroluminescent display panel of claim 9 wherein the edges of said metal assist structure are chamfered.

11. The sunlight viewable electroluminescent display panel of claim 10 wherein said layer of light absorbing dark material has a dielectric constant of at least seven.

12. The sunlight viewable electroluminescent display panel of claim 11 wherein said metal assist structure covers about 10% or less of said transparent electrode.

13. The sunlight viewable electroluminescent display panel of claim 12 wherein said layer of light absorbing dark material is a graded layer of light absorbing dark material.

14. The sunlight viewable electroluminescent display panel of claim 13 wherein said graded layer of light absorbing dark material comprises a nonstoichoemetric silicon nitride, $SiN_x$.

15. A sunlight viewable multi-color electroluminescent display panel, comprising:

a glass substrate;

a plurality of parallel transparent electrodes deposited on said glass substrate, each of said transparent electrodes having a metal assist structure formed on and in electrical contact over a portion of said transparent electrodes;

a first dielectric layer deposited on said plurality of transparent electrodes;

a layer of phosphor material deposited on said first dielectric layer having a preselected activator and a preselected co-activator implanted therein to provide color luminescent material;

a second dielectric layer deposited on said layer of phosphor material; and a plurality of metal electrodes each deposited in parallel over said second dielectric layer, each of said metal electrodes comprising a layer of light absorbing dark material between said second dielectric layer and the electrically conductive portion of said metal electrodes.

16. The sunlight viewable electroluminescent display panel of claim 15 wherein said layer of light absorbing dark material is a graded layer of light absorbing dark material.

17. The sunlight viewable electroluminescent display panel of claim 16 wherein said layer of light absorbing dark material has an absorption coefficient of about $10^5$/cm.

18. The sunlight viewable electroluminescent display panel of claim 17 wherein said layer of light absorbing dark material is $PrMnO_3$.

19. The sunlight viewable electroluminescent display panel of claim 16 wherein said graded layer of light absorbing dark material comprises a nonstoichiometric silicon nitride, $SiN_x$.

20. The sunlight viewable electroluminescent display panel of claim 19 wherein said layer of light absorbing dark material is GeN.

* * * * *